United States Patent [19]

Leach

[11] 4,050,857

[45] Sept. 27, 1977

[54] INCOMING GATED RELIEF VALVE

[75] Inventor: Paul A. Leach, Jaffrey, N.H.

[73] Assignee: Jaffrey Fire Protection Company, Inc., Jaffrey, N.H.

[21] Appl. No.: 686,385

[22] Filed: May 14, 1976

[51] Int. Cl.[2] ..... F04B 49/00; A62C 27/20

[52] U.S. Cl. ..... 417/309; 137/115; 169/24; 417/234; 417/434; 417/442; 417/510

[58] Field of Search ..... 137/115; 169/24; 417/307, 309, 434, 435, 510, 440, 234, 252, 442

[56] References Cited

U.S. PATENT DOCUMENTS

| | | | |
|---|---|---|---|
| 588,399 | 8/1897 | Cox | 169/24 |
| 731,893 | 6/1903 | Hall | 417/435 |
| 2,241,857 | 5/1941 | Hisaw | 169/24 |

*Primary Examiner*—Carlton R. Croyle
*Assistant Examiner*—Gregory P. LaPointe
*Attorney, Agent, or Firm*—Pearson & Pearson

[57] ABSTRACT

A gate valve is threadedly attached to an influent port of a motorized pump of a vehicular fire engine at all times. Thus it is not necessary to stop the pump, remove a cap and connect a water supply hose to the influent port. Instead the supply hose is connected to the gate valve, the valve is purged of air, and then opened to connect the new source without air hammer, or flow interruption. A pressure relief valve on the suction side of the gate, relieves pump pressure whether the gate is open or closed.

2 Claims, 3 Drawing Figures

INCOMING GATED RELIEF VALVE

BACKGROUND OF THE INVENTION

It has heretofore been proposed to provide one or more gate valves on pumping apparatus as in the main pump-booster pump system of U.S. Pat. No. 2,428,256 to Yates of Sept. 30, 1947.

It is also well known to provide pressure relief valves in fire fighting, or other liquid, systems, the valve usually being located on the hose side of the pumps to protect the hose from fracture.

SUMMARY OF THE INVENTION

In this invention, a motorized pump of the type having a plurality of influent ports, each closed with a threaded cap, except for one port connected to a tank, or other source of water, is provided with an incoming gated relief valve threaded on at least one of the other influent ports in place of a cap.

The gated relief valve of the invention includes a gate reciprocable in a gate chamber, manually, to move in a plane normal to the direction of flow, so that a hose from a new, or second, source of water can be readily attached to the influent port of the valve, and the gate then opened without interruption of flow, or down time of the pump for attachment.

In addition, the gated relief valve of the invention includes an air bleeder valve for removing any air on the suction side of the pump before the gate is opened. It also includes a pressure relief valve, integrally mounted therein, on the suction side of the gate and pump whereby undue pressure is relieved in the pump, rather than in the hose, even if the gate is closed.

DESCRIPTION OF A PREFERRED EMBODIMENT

Figure 1:
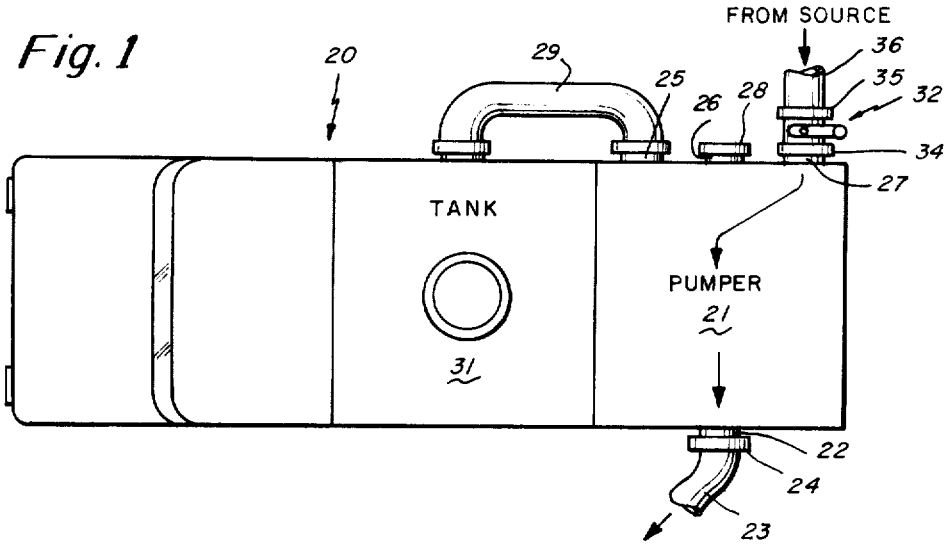
FIG. 1 illustrates a typical vehicular fire engine including the incoming gated relief valve of the present invention.

As shown in the drawing, a typical vehicular fire engine 20, includes a motorized pump 21, having at least one effluent port 22 for connection to a flexible fire hose 23 by means of a quick attachable quarter turn hose coupling 24. Port 22 is on the pressure side of the pump 21.

On the suction side of pump 21, there are usually at least two influent ports such as 25, 26 and 27, normally closed by threaded caps such as 28. One influent port 25, normally has its cap 28 removed and is connected by the conduit 29 to the water tank 31 of the fire engine 20, so that the vehicle carried water supply may be immediately discharged onto a fire upon arrival of the engine at the fire location.

When the contents of the tank 31 have been exhausted, the pump has been shut down while a cap 28 is unthreaded and a new supply hose coupled onto one of the ports 26 or 27. If a cap 28 were removed, while the pump was exhausting the tank 31, an air hammer would develop which would damage the pump.

In this invention, an incoming gated relief valve 32 is always carried on one of the influent ports such as 27, and preferably on all unused ports such as 26, so that the pump can be quickly fed from a second or third source at any time without air hammer or flow interruption.

The valve body 33 is made especially thin by using a vertically reciprocable gate rather than a cylindrical type gate, so that it will not unduly project from the fire truck 20 and be inadvertently knocked off.

Figure 2:
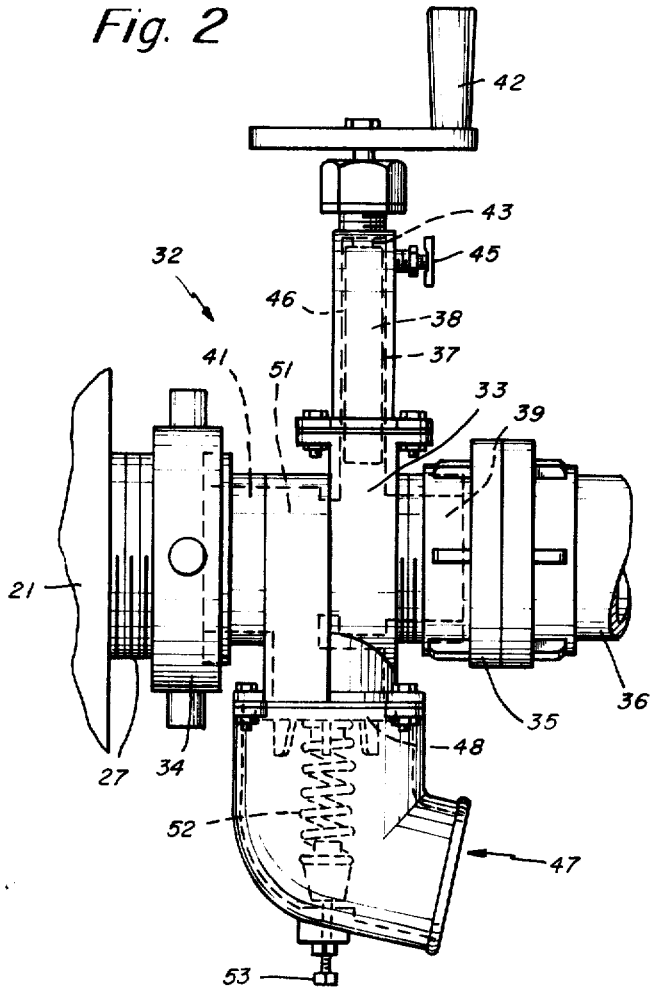
FIG. 2 is an enlarged side view of the incoming gated relief valve of the present invention.
Figure 3:
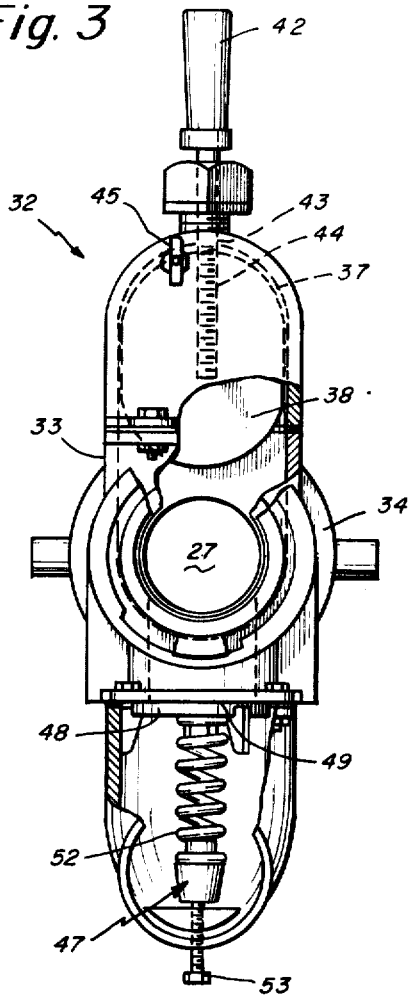
FIG. 3 is an enlarged front view of the incoming gated relief valve of the present invention.

As best shown in FIGS. 2 and 3, valve 32 includes a quick attachable coupling 34 of the quarter turn type, threaded on influent, or suction, port 27 and a suitable coupling 35 for quick attachment of a flexible four inch diameter hose 36. Valve body 33 includes a gate chamber 37 for a gate 38, the gate being reciprocable in a plane normal to the direction of flow from the influent port 39 of the valve to the effluent port 41 thereof. A turn handle 42, on valve body 33 rotates a rod 43 threadedly connected in gate 38 as at 44 to raise and lower the gate in chamber 37.

An air bleeder valve 45 is provided in the upper portion of body 33 to vent the upstanding, vertically extending gate chamber 37, the horizontally extending main valve chamber 51 and the other portions of the system on the suction side 46 of the gate, when the gate is closed, to be sure no air is trapped in the system before opening the gate to connect a new source of water into the system.

A pressure relief valve 47 is provided in the lower portion of body 33 in the form of a valve closure 48, in a valve seat 49 connecting a discharge vent with the lower portion of the horizontal main valve chamber 51 on the suction side of the gate. Valve closure 48 is spring biased to closed position by a coil spring 52, the compression thereof being threadedly adjustable by turn nuts 53. Usually the relief valve 47 is preset at the factory to release at about 40 to 60 pounds per square inch.

It will be seen that by carrying a gated relief valve 32 on at least one suction port of the pump of each fire engine, the flow of water to the flame is never interrupted when tieing into main stream. The relief valve can be adjusted to any desired pounds per square inch and will relieve undue pressure in the pump even when the gate is closed thereby protecting the entire pumping system, while also guarding against water hammers which can seriously damage a pump.

I claim:

1. In combination:

a fire engine pump having at least one pressure outlet for connection to a fire hose for fighting a fire and having at least two suction inlets for connection to a source of fire fighting liquid;

a water supply conduit connected to one said inlet;

an incoming, gated, valve threadedly mounted on another of said suction inlets, said valve having a thin body with a horizontally extending main valve chamber and a vertically extending valve gate chamber; a normally-closed, manually-operable gate reciprocable in a plane normal to the direction of flow through said main valve chamber, in said gate chamber an air bleeder valve in the upper portion of said body and a coil spring-biased, normally closed, automatic pressure-relief valve incorporated in said valve in the lower portion of said body and on the suction side of the gate thereof; said valve body including a discharge vent for said pressure relief valve the location of said relief valve and said air bleeder valve inside said reciprocable gate enabling said valves to relieve undue air and water pressure in said pump despite said gate being closed.

2. An incoming gated relief valve for permanent mounting on the suction inlet of a fire engine pump said valve comprising:

a thin valve body having a main horizontal valve chamber with an effluent port spaced from an influent port, each said port having a quarter turn hose coupling thereon;

said thin body having an integral upstanding gate chamber with a manually-operable, normally-closed gate reciprocable, in said gate chamber, in a plane normal to the horizontal direction of flow through said main chamber between said ports, said gate having a pump suction side and an incoming water side;

an automatically operated pressure relief valve integrally formed in the lower portion of said body, said valve having a spring biased valve movable in a discharge vent in said body, said relief valve being on the pump suction side of said gate to relieve pressure in said pump whether said gate is open or closed;

and a manually operated air bleeder valve formed in the upper portion of said body; said valve for bleeding off any air in said pump before said gate is opened to insure solid water to said pump.

* * * * *